US011482085B2

(12) United States Patent
Hanes

(10) Patent No.: US 11,482,085 B2
(45) Date of Patent: Oct. 25, 2022

(54) DEVICE HAPTIC FEEDBACK

(71) Applicant: HEWLETT-PACKARD DEVELOPMENT COMPANY, L.P., Houston, TX (US)

(72) Inventor: David H Hanes, Fort Collins, CO (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 1093 days.

(21) Appl. No.: 16/080,970

(22) PCT Filed: Apr. 27, 2017

(86) PCT No.: PCT/US2017/029809
§ 371 (c)(1),
(2) Date: Aug. 29, 2018

(87) PCT Pub. No.: WO2018/199951
PCT Pub. Date: Nov. 1, 2018

(65) Prior Publication Data

US 2021/0201631 A1 Jul. 1, 2021

(51) Int. Cl.
*G08B 6/00* (2006.01)
*A45C 3/02* (2006.01)
(Continued)

(52) U.S. Cl.
CPC ..... *G08B 6/00* (2013.01); *A45C 3/02* (2013.01); *A45C 3/06* (2013.01); *A45C 15/00* (2013.01);
(Continued)

(58) Field of Classification Search
CPC ..... G08B 13/14; G08B 21/00; G08B 6/00; G07C 9/00; A45F 3/02; A45F 3/04;
(Continued)

(56) References Cited

U.S. PATENT DOCUMENTS 7,863,862 B2 1/2011 Idzik et al.
8,319,630 B1 * 11/2012 Salwan ..... A45C 15/06 383/61.3
(Continued)

FOREIGN PATENT DOCUMENTS

CN 101577030 A 11/2009
CN 102724353 A 10/2012
(Continued)

OTHER PUBLICATIONS

NPL Search (Jan. 28, 2022).*
(Continued)

*Primary Examiner* — Van T Trieu
(74) *Attorney, Agent, or Firm* — Austin Rapp

(57) ABSTRACT

Examples associated with device haptic feedback are described. One example bag includes a power source integrated into the bag. The power source may provide power to an electronic device. The bag includes a device monitor module to monitor a state of the electronic device. A haptic feedback generator provides a haptic signal to a holder of the bag. The signal may be provided in response to a signal from the device monitor module regarding the state of the electronic device.

14 Claims, 4 Drawing Sheets

(51) Int. Cl.

| | |
|---|---|
| ***A45C 3/06*** | (2006.01) |
| ***A45C 15/00*** | (2006.01) |
| ***A45F 3/02*** | (2006.01) |
| ***A45F 3/04*** | (2006.01) |
| *A45F 3/00* | (2006.01) |

(52) U.S. Cl.
CPC ..... *A45F 3/02* (2013.01); *A45F 3/04* (2013.01); *A45F 2003/003* (2013.01)

(58) Field of Classification Search
CPC .... A45C 3/02; A45C 3/06; A45C 5/00; A45C 5/03; A45C 13/00; A45C 13/103; A45C 13/18; A45C 13/24; A45C 15/00; A45C 15/06
See application file for complete search history.

(56) References Cited

U.S. PATENT DOCUMENTS

| | | | | |
|---|---|---|---|---|
| 9,559,743 | B2 | 1/2017 | Del Toro et al. | |
| 9,770,084 | B1 * | 9/2017 | Shiekh | A45C 13/005 |
| 9,907,380 | B2 * | 3/2018 | Reh | A45C 13/18 |
| 2011/0094598 | A1 | 11/2011 | Lawson | |
| 2011/0284598 | A1 | 11/2011 | Lawson | |
| 2014/0000771 | A1 | 1/2014 | Sherman et al. | |
| 2014/0002239 | A1 * | 1/2014 | Rayner | G08B 13/2462 340/5.61 |
| 2015/0050965 | A1 | 2/2015 | Perry | |
| 2015/0091817 | A1 | 4/2015 | Chien | |
| 2015/0366333 | A1 | 12/2015 | Zhijian | |
| 2016/0173160 | A1 * | 6/2016 | Gronewoller | H04M 1/0258 455/575.8 |
| 2017/0061753 | A1 | 3/2017 | Khoshkava et al. | |
| 2020/0126388 | A1 * | 4/2020 | Kranz | G08B 21/0453 |

FOREIGN PATENT DOCUMENTS

| | | | |
|---|---|---|---|
| CN | 203986584 | U | 12/2014 |
| CN | 104490376 | A | 4/2015 |
| CN | 106484097 | A | 3/2017 |

OTHER PUBLICATIONS

"Charge your iPhone with your Smart Battery Case", Retrieved from Internet: https://support.apple.com/en-us/HT205443, 2016, 3 Pages.

"Samsung Gear Iconx", Samsung, User Manual, Retrieved from Internet: https://static.bhphotovideo.com/lit_files/268655.pdf, 2016, 37 Pages.

* cited by examiner

DEVICE HAPTIC FEEDBACK

BACKGROUND

People carry many types of electronic devices with them throughout their daily lives. These devices may include, for example, cell phones, tablets, laptops wearables, and so forth. The devices may be carried in, for example, backpacks, purses, briefcases, messenger bags, and so forth.

BRIEF DESCRIPTION OF THE DRAWINGS

The present application may be more fully appreciated in connection with the following detailed description taken in conjunction with the accompanying drawings.

DETAILED DESCRIPTION

Systems, methods, and equivalents associated with device haptic feedback are described. While a user is carrying around an electronic device in their bag (e.g., backpack, purse, briefcase) or pocket, the user may desire to know certain states of that device and/or whether they have received an incoming message (e.g., text message, call, email) via that device. In some examples, the electronic device may be able to interface with a bag the user is carrying, and send the user a message via a haptic device or other component of the bag (e.g., a display, lights, a speaker). This may allow the bag to inform the user when the device is, for example, low on battery so that the device can be charged. When the bag itself carries a power supply from which devices can be charged, the user may then be able to charge the device in the bag that notified the user of the state of the device.

It is appreciated that, in the following description, numerous specific details are set forth to provide a thorough understanding of the examples. However, it is appreciated that the examples may be practiced without limitation to these specific details. In other instances, methods and structures may not be described in detail to avoid unnecessarily obscuring the description of the examples. Also, the examples may be used in combination with each other.

"Module", as used herein, includes but is not limited to hardware, firmware, software stored on a computer-readable medium or in execution on a machine, and/or combinations of each to perform a function(s) or an action(s), and/or to cause a function or action from another module, method, and/or system. A module may include a software controlled microprocessor, a discrete module, an analog circuit, a digital circuit, a programmed module device, a memory device containing instructions, and so on. Modules may include gates, combinations of gates, or other circuit components. Where multiple logical modules are described, it may be possible to incorporate the multiple logical modules into one physical module. Similarly, where a single logical module is described, it may be possible to distribute that single logical module between multiple physical modules.

Figure 1:
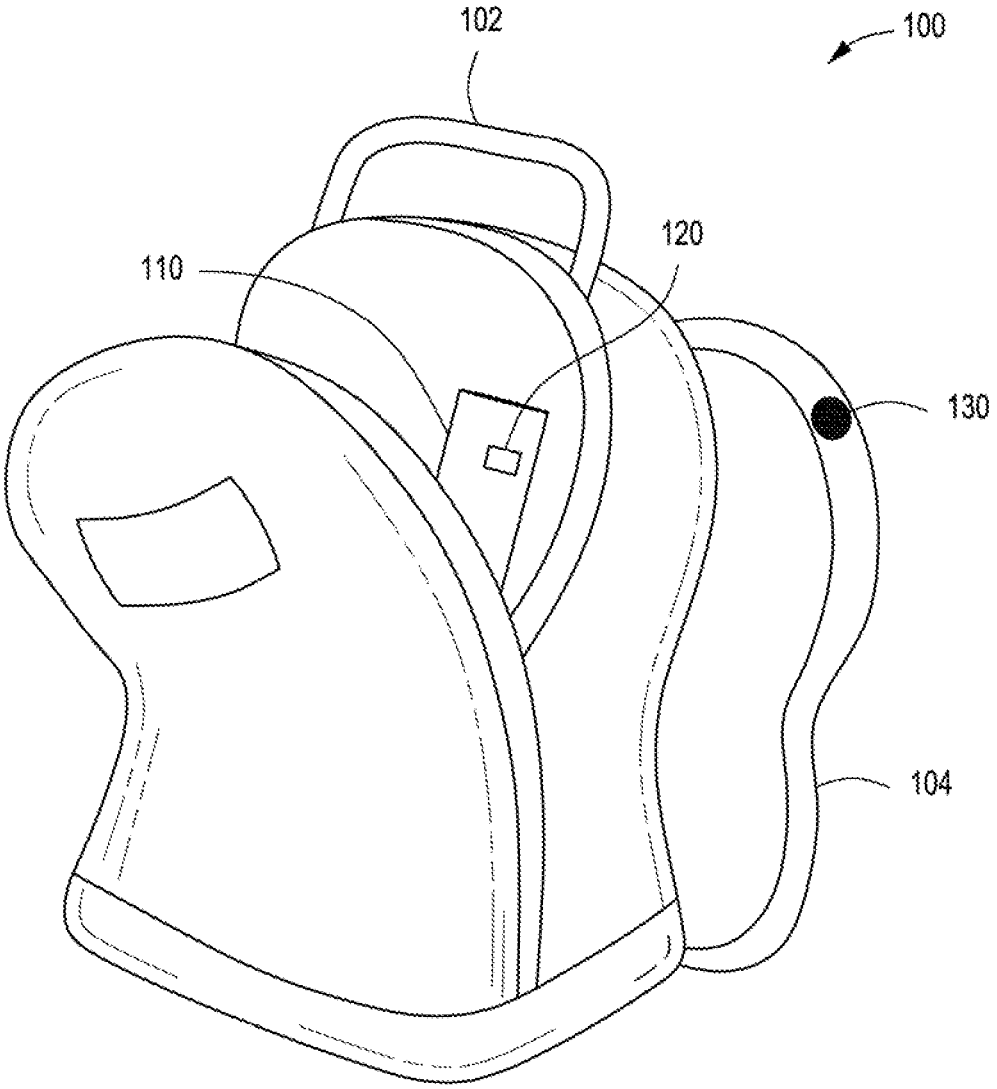
FIG. 1 illustrates an example bag associated with device haptic feedback.

FIG. 1 illustrates an example bag associated with device haptic feedback. In this example, bag 100 is illustrated as a backpack. In other examples, bag 100 may be a different type of container such as a purse, a messenger bag, a briefcase, and so forth. The bag may be constructed from a variety of materials including cloths, leathers, and so forth, and be formed into a variety of shapes depending on the nature of the bag. It should be appreciated that the items depicted in FIG. 1 are illustrative examples, and many different components, may operate in accordance with various examples.

Bag 100 includes a power source 110. Power source 110 may be integrated into bag 100. Here, power source 110 may be integrated into a pouch of bag 100. In various examples, power source 110 may be removable and/or replaceable from bag 100. Depending on the design of power source 110 and/or bag 110 it may be possible to charge power source 110 from an external power source (e.g., a wall outlet) while power source 110 is situated within bag 100 for example, using a power cord embedded in bag 100 (not shown). In other examples where power source 110 is removable from bag 100, power source 110 may be chargeable when removed from bag 100 by placing it in a dedicated charger, connecting via a cable to a wall outlet, and so forth. Power source 110 may provide power to at least one electronic device. In some examples, power may be provided by cables also integrated into bag 100. These cables may extend into different pouches of bag 100 to allow multiple devices to connect to power source 110. In other examples, power source 110 may be configured to receive predefined types of cables (e.g., universal serial bus) supplied by a user of the electronic device and/or bag 100. The electronic device may be, for example, a cell phone, a tablet, a laptop, a wearable (e.g., a smartwatch), and so forth. In some examples, circuitry and/or cables in bag 100 may allow the electronic device to be charged while inside bag 100 and/or within a proximity to bag 100 that allows usage of the electronic device. For example, a cable may extend out of bag 100 to connect a laptop to power source 110 such that bag 100 can rest on the floor under a table or desk on which the laptop is situated.

Bag 100 also includes a device monitor module 120. In this example, device monitor module 120 may be integrated with power source 110, though in other examples, device monitor module 120 may be a separate component integrated with a different portion of bag 100. Device monitor module 120 may draw power from power source 110, from its own battery, and so forth. Device monitor module 120 may monitor a state of electronic devices. The devices monitored by device monitor module 120 may be, for example, devices connected to power source 110, devices configured to wirelessly communicate with device monitor module 120 (e.g., via a paring action), and so forth. The state of the electronic devices may relate to, for example, battery charge levels of the electronic device, whether an incoming message (e.g., text, email) has been recently received by an electronic device, whether a call is being received by an electronic device, and so forth. In various examples, device monitor module 120 may communicate with the electronic device via, for example, Bluetooth, Wi-Fi, Wi-Fi Direct, near field communication, radio frequency identification, ZigBee, Z-wave, a wired connection between the electronic device and power source 110, and so forth.

Bag 100 also includes a haptic feedback generator 130. In this example, haptic feedback generator 130 is illustrated as residing in a strap 104 of bag 100. In other examples, haptic feedback generator 130 may reside within a different portion of bag 100 such as handle 102. While one haptic feedback generator 130 is shown in bag 100, in alternative examples, bag 100 may contain multiple haptic feedback generators in strap(s) 104, handle(s) 102, or other portions of bag 100. Haptic feedback generator 130 may provide a haptic signal to a holder of bag 100 in response to a signal received from device monitor module 120. The signal may relate to the state of the at least one electronic device. Thus, bag 100 may have circuitry connecting device monitor module 120 and/or power source 110 to haptic feedback generator 130.

In some examples, bag 100 may also include a control module (not shown). The control module may be integrated with device monitor module 120. The control module may communicate with a device module on the electronic device. The device module may allow a user of the electronic device to designate a state of the electronic device for which haptic signals are provided to the holder of bag 100. For example, the user may desire that the bag deliver a haptic signal when the battery level of an electronic device reaches a predefined value. In another example, the user may desire that the bag deliver a haptic signal when the electronic device receives a text message. Other scenarios for which haptic signals are delivered are also possible.

The device module may also allow the user to configure a nature of the haptic signal provided to the holder of the bag. For example, this may allow the user to configure the duration, repetition, and so forth of haptic signals provided by haptic signal generator 130 in response to various events detected in an electronic device. This may allow the user to receive different haptic signals in response to different device events to allow the user to understand the nature of the event that occurred without having to retrieve the device from their bag. By way of illustration, consider a case where a user has designated a single haptic signal to designate that an electronic device has fully charged, and a double haptic signal to designate that the electronic device has received a text message. Depending on whether the user receives the single or double haptic signal, the user may seek to retrieve the electronic device from bag 100 to take some action.

Figure 2:
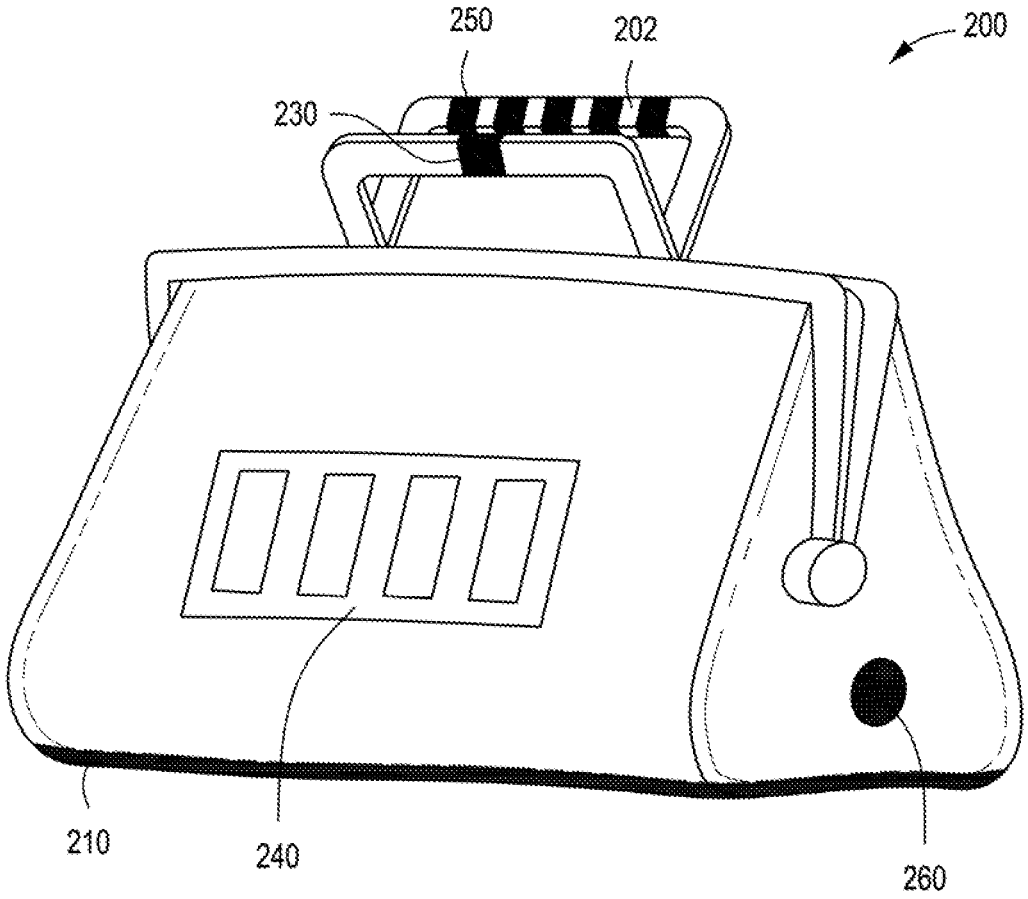
FIG. 2 illustrates another example bag associated with device haptic feedback.

FIG. 2 illustrates another example bag 200. In this example bag 200 is illustrated as a purse. Bag 200 includes many features similar to those described above with reference to bag 100. For example, bag 200 includes a power source 210 integrated into bag 200 for providing power to an electronic device, and a haptic feedback generator 230 embedded in a handle 202 of bag 200. Here, power source 210 may be integrated into the bottom of bag 100. While not shown, bag 200 may also include a device monitor module to monitor a state of the at least one electronic device. As described above, the device monitor module may be embedded within another component of bag 200 (e.g., power source 210, display 240)

Bag 200 also includes a display 240, a light source 250, and an audio source 260. Display 240, light source 250, and audio source 260 may provide information regarding the state of the electronic device, power supply 210, and so forth. Consequently, display 240, light source 250, and audio source 260 may be communicatively coupled to the device monitor module and/or power source 210. This may allow the monitor module to control the outputs of display 240, light source 250, audio source 260, and so forth. For example, display 240 may show a battery level of the electronic device or power source 210. In other examples, display 240 may be able to display text messages or other state information regarding the electronic device, such as a phone number or name associated with an incoming call.

Similarly, light source 250 may be configured to show information regarding the state of the electronic device. For example, in FIG. 2, light source 250 is illustrated as having five lighting elements. Depending on the battery level of the electronic device, a differing number of the lighting elements may be turned on. For example, if the battery level of the electronic device has a remaining charge between sixty percent and eighty percent, three of the lighting elements may be turned. Other state information regarding the electronic device may be conveyed by, for example, by blinking light source 250, and so forth. Audio source 260 may also convey information regarding the electronic device by, for example, playing tones or messages as controlled by the device monitor module. In various examples, the tones and/or messages may be predefined, configurable, generated based on the event, and so forth. By way of illustration, a device reaching full charge may be indicated by a single tone, a phone call may cause audio source to play a voice message such as "you are receiving a phone call from Frank," and so forth.

Figure 3:
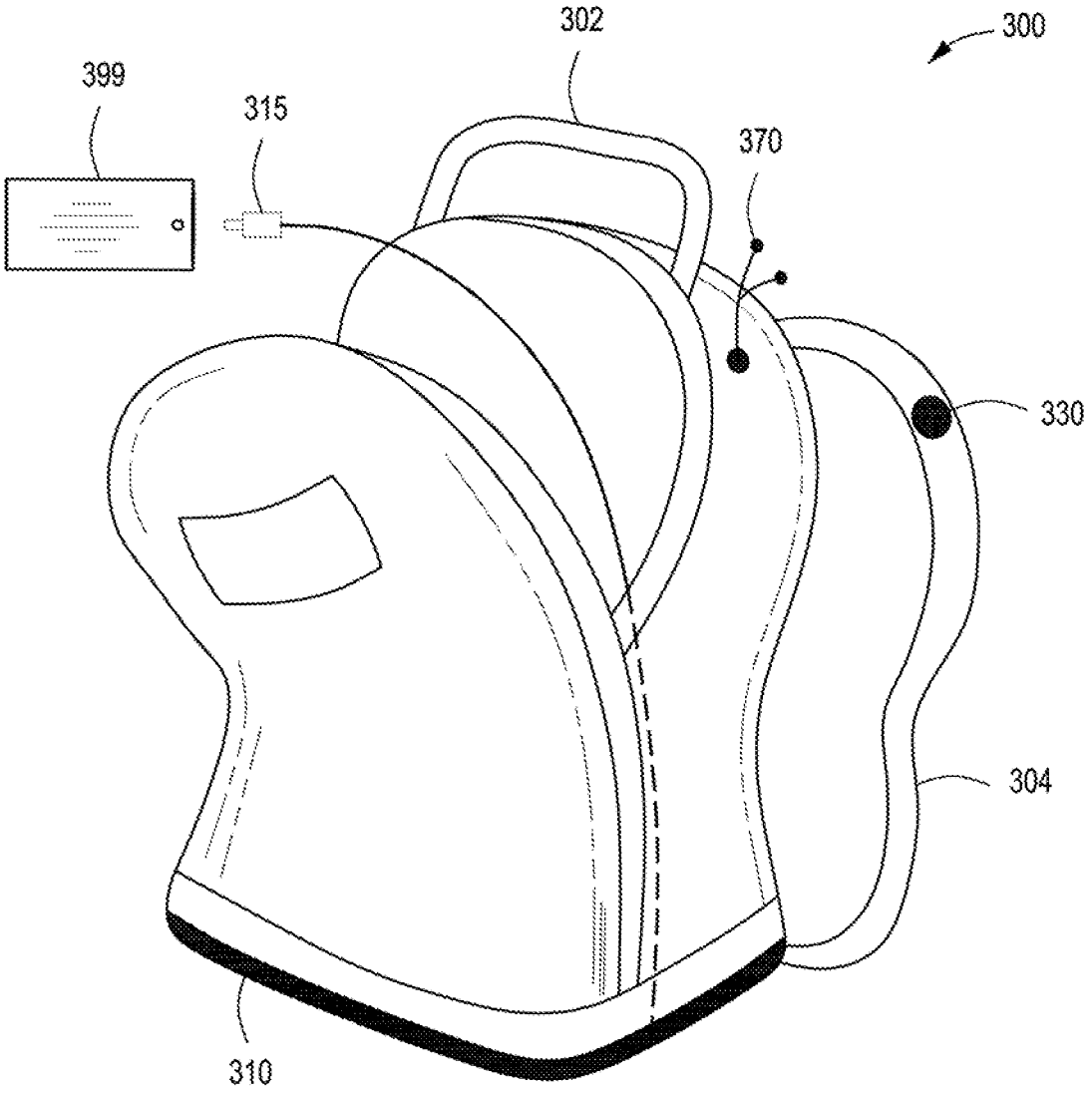
FIG. 3 illustrates an example backpack associated with device haptic feedback.

FIG. 3 illustrates a backpack 300. Backpack 300 includes a power source 310. Power source 310 may be integrated into backpack 300. Here power source 310 is integrated into the bottom of backpack 300. In various examples, power source 310 may be removable, replaceable, upgradable, and so forth without otherwise affecting functionally affecting or damaging backpack 300.

Backpack 300 also includes a cable 315. Cable 315 may couple an electronic device 399 to power source 310. Cable 315 may implement a variety of technologies that facilitate transferring power from power source 310 to an electronic device (e.g., universal serial bus). Electronic device 399 as illustrated is a mobile phone. However, electronic device 399 could also be a tablet, a laptop computer, a wearable and so forth.

Backpack 300 also includes a shoulder strap 304 containing a haptic feedback generator 330. In cases where backpack 300 includes multiple haptic feedback generators 330, other haptic feedback generators 330 may be embedded in other straps, handles 302, and so forth. Haptic feedback generators may be coupled to power supply 310 to draw energy to provide haptic signals to a user of backpack 300.

Backpack 300 also includes a device monitor module. While not shown, the device monitor module may be embedded in another component of backpack 300 (e.g., power source 310, haptic feedback generator 330). The device monitor module may receive information from electronic device 399. The information received from electronic device 399 may be received via cable 315 and circuitry embedded in backpack 300, via a wireless signal (e.g., Bluetooth), and so forth. In some examples, electronic device 399 may push information to the device monitor module in response to events that occur on electronic device 399. The information received from electronic device 399 may be conveyed by the device monitor module to a wearer of the backpack via haptic feedback generator 330. The information may relate to, for example, a state of electronic device 399 (e.g., battery level), a message incoming to electronic device 399, and so forth.

Backpack 300 also includes a pair of retractable headphones 370. Retractable headphones 370 may be able to convey audio from electronic device 399 to a user of the backpack. By way of illustration, the user may be able to pull retractable headphones 370 from their retracted position into a usable position and comfortably wear retractable headphones 370 while wearing the backpack. This may allow the user to listen to audio from electronic device 399. In examples where retractable headphones 370 include a microphone component, retractable headphones 370 may also allow a user of the backpack to take calls incoming to electronic device 399. In various examples, audio signals may be transmitted between headphones 370 and electronic device 399 via cable 315, via a wireless connection between electronic device 399 and the device monitor module, via other circuitry embedded within backpack 300, and so forth.

Figure 4:
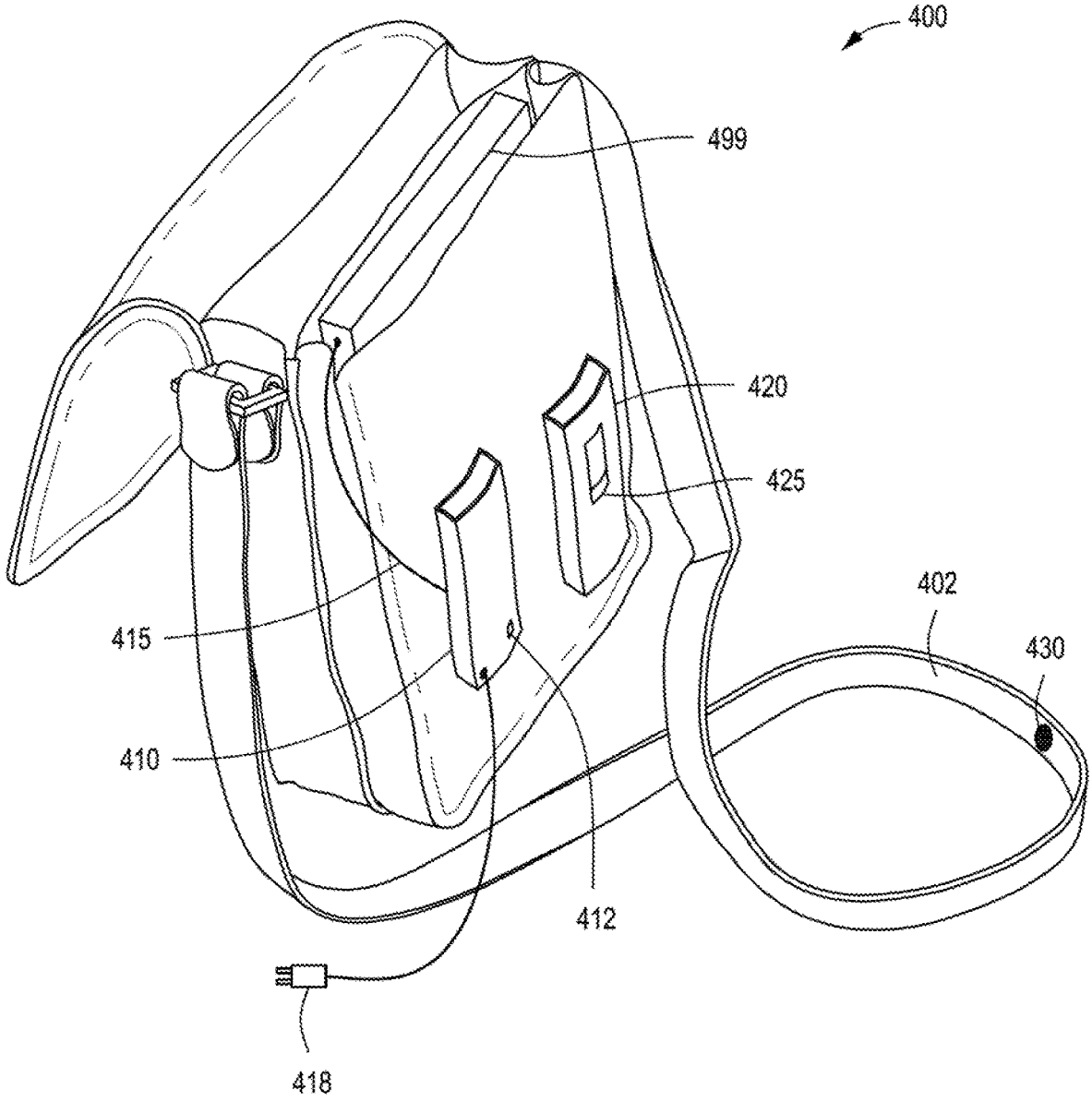
FIG. 4 illustrates another example bag associated with device haptic feedback.

FIG. 4 illustrates another bag 400 associated with device haptic feedback. In this example bag 400 is illustrated as a messenger bag, though in other examples, bag 400 could be, for example a backpack, a purse, a briefcase, and so forth. Bag 400 includes at least one cable 415. Cable 415 may provide power to at least one electronic device 499 stored within a subsection of bag 400. Here, electronic device 499 is illustrated as a laptop, though other types of electronic devices may be used. Cable 415 may be a type of cable designed to charge electronic device 499. Thus, for an electronic device 499 designed to charge via a universal serial bus, cable 415 may be a universal serial bus cable.

Bag 400 also includes a chamber 410 for a power source. Chamber 410 may include an electric coupling 412. Electric coupling 412 may couple a power source inserted into chamber 410 to electronics in bag 400. These electronics may provide a connection between cable 415 and the power source, allowing power to be transmitted to electronic device 499. Electronic coupling 412 may also facilitate providing power to other electronic components of bag 400. Chamber 410 may allow a user to separately purchase their own power source for bag 400 and use that power source for charging electronic device 499, this may be more economical for some users than a bag with an embedded power source.

Bag 400 also includes a device monitor module 420. Device monitor module 420 may monitor a state of the at least one electronic device. In this example, device monitor module 420 is illustrated as being embedded in a component of bag 400 separate from chamber 410. In other examples, device monitor module 420 may be embedded in chamber 410 to reduce the quantity of electronic and cabling components used for manufacturing bag 400.

Bag 400 also includes a haptic feedback generator 430. Here, haptic feedback generator 430 is embedded in strap 402, though in other examples, haptic feedback generator 430 may be embedded in other components of bag 400. Haptic feedback generator 430 may provide a haptic signal to a holder of bag 400. The haptic signal may be provided in response to a signal received from device monitor module 420 regarding the state of electronic device 499.

Bag 400 also includes a power cord 418. Power cord 418 may provide power from an external power source such as a wall outlet to the at least one electronic device via the at least one cable. Power cord 418 may also provide power to other components of bag 400 and/or to a power source inserted into chamber 410.

Bag 400 also includes a battery 425. Battery 425 may provide power to device monitor module 420, haptic feedback generator 430, and other electronic components of bag 420 while there is no power source in chamber 410.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the scope of the disclosure. Thus, the present disclosure is not intended to be limited to the examples shown herein but is to be accorded the widest scope consistent with the principles and novel features disclosed herein.

What is claimed is:

1. A bag, comprising:

a power source integrated into the bag for providing power to an electronic device;

a device monitor module to monitor a state of the electronic device inside the bag;

a first haptic feedback generator in a first portion of the bag;

a second haptic feedback generator in a second portion of the bag; and wherein the first haptic feedback generator and the second haptic feedback generator provide a haptic signal to a holder of the bag in response to a signal from the device monitor module regarding the state of the electronic device, wherein the state of the electronic device relates to one of a battery charge level of the electronic device, an incoming message received by the electronic device, and an incoming call being received from the electronic device.

2. The bag of claim 1, where the bag is one of, a backpack, a purse, a messenger bag, and a briefcase.

3. The bag of claim 1, where the first haptic feedback generator resides in one of a strap and a handle of the bag.

4. The bag of claim 1, further comprising a third haptic feedback generator.

5. The bag of claim 1, comprising at least one of a light source, a display, and an audio source to provide information regarding the state of the electronic device.

6. The bag of claim 1, comprising a control module to communicate with a device module on the electronic device that allows a user of the electronic device to designate a state of the electronic device for which haptic signals are provided to the holder of the bag, and to configure a nature of the haptic signal provided to the holder of the bag.

7. The bag of claim 1, where the electronic device and the device monitor module communicate via one of Bluetooth, Wi-Fi, Wi-Fi Direct near field communication, radio frequency identification, ZigBee, Z-wave, and a wired connection between the electronic device and the power source.

8. The bag of claim 1, where the electronic device is one of a mobile telephone, a smartwatch, a tablet computer, and a laptop computer.

9. A backpack, comprising:

a power source integrated into the backpack;

a cable to couple an electronic device inside the backpack to the power source;

a shoulder strap containing a first haptic feedback generator;

a second haptic feedback generator in a second portion of the bag; and a device monitor module to receive information from the electronic device, and to convey that information to a wearer of the backpack via the first haptic feedback generator and the second haptic feedback generator, wherein the state of the electronic device relates to one of a battery charge level of the electronic device, an incoming message received by the electronic device, and an incoming call being received from the electronic device.

10. The backpack of claim 9, where the information relates to one of a state of the electronic device and a message incoming to the mobile device.

11. The backpack of claim 9 comprising a pair of retractable headphones to convey audio from the electronic device to a user of the backpack.

12. A bag, comprising:

a cable for providing power to an electronic device stored within a subsection of the bag;

a chamber for a power source, the chamber comprising an electric coupling for providing power from the power source to the electronic device via the cable;

a first haptic feedback generator in a first portion of the bag;

a second haptic feedback generator in a second portion of the bag;

a device monitor module to monitor a state of the electronic device inside the bag; and wherein the first haptic feedback generator and the second haptic feedback generator provide a haptic signal to a holder of the bag in response to a signal received from the device monitor module regarding the state of the electronic device, wherein the state of the electronic device relates to one of a battery charge level of the electronic device, an incoming message received by the electronic device, and an incoming call being received from the electronic device.

13. The bag of claim 12, comprising a power cord for providing power from an external power source to the electronic device via the cable.

14. The bag of claim 12, comprising a battery to provide power to the device monitor module and the haptic feedback generator.

* * * * *